US006089057A

United States Patent [19]

Spurr

[11] Patent Number: 6,089,057

[45] **Date of Patent: *Jul. 18, 2000**

[54] VEHICLE DOOR LOCK ACTUATOR

[75] Inventor: Nigel Spurr, Hall Green, United Kingdom

[73] Assignee: Meritor Light Vehicle Systems (UK) Lt., Birmingham, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/052,000

[22] PCT Filed: Sep. 18, 1996

[86] PCT No.: PCT/GB96/02289

§ 371 Date: Jul. 29, 1998

§ 102(e) Date: Jul. 29, 1998

[87] PCT Pub. No.: WO97/15740

PCT Pub. Date: May 1, 1997

[30] Foreign Application Priority Data

Oct. 25, 1995 [GB] United Kingdom ..... 9521851

[51] Int. Cl.[7] ..... E05B 53/00

[52] U.S. Cl. ..... 70/264; 70/262; 70/279.1; 292/216

[58] Field of Search ..... 70/262–264; 292/201, 292/216, 336.3, DIG. 62, DIG. 65

[56] References Cited

U.S. PATENT DOCUMENTS

| | | | |
|---|---|---|---|
| 4,986,098 | 1/1991 | Fisher | 70/262 |
| 5,054,300 | 10/1991 | Nakahara et al. | 70/262 |
| 5,066,054 | 11/1991 | Ingenhoven | 292/201 |
| 5,078,436 | 1/1992 | Kleefeldt et al. | 70/264 X |
| 5,309,745 | 5/1994 | Ursel et al. | 70/264 |
| 5,419,597 | 5/1995 | Brackmann et al. | 70/264 X |
| 5,438,855 | 8/1995 | Ikeda | 70/279.1 |
| 5,439,261 | 8/1995 | O'Hare | 292/201 X |
| 5,453,671 | 9/1995 | Baier et al. | 70/264 X |
| 5,497,640 | 3/1996 | Kokuryo | 70/279.1 X |
| 5,577,782 | 11/1996 | Johnson et al. | 292/216 |
| 5,603,537 | 2/1997 | Amano et al. | 70/264 X |
| 5,715,713 | 2/1998 | Aubry et al. | 70/264 X |
| 5,722,272 | 3/1998 | Bridgeman et al. | 70/264 |
| 5,874,815 | 2/1999 | Griessbach | 70/264 X |

FOREIGN PATENT DOCUMENTS

| | | | |
|---|---|---|---|
| 0 231 042 A2 | 8/1987 | European Pat. Off. | E05B 47/00 |
| 1408441 | 10/1975 | United Kingdom . | |
| 2285 476A | 7/1995 | United Kingdom | E05B 47/00 |
| 2300 668A | 11/1996 | United Kingdom | E05B 65/36 |

*Primary Examiner*—Suzanne Dino Barrett
*Attorney, Agent, or Firm*—Wood, Phillips, VanSanten, Clark & Mortimer

[57] ABSTRACT

A power actuator for a vehicle door locking mechanism includes a power operable actuator lever, a manual locking lever operated by a sill button or the like, and a transmission connector selectively coupling the power operable and manual levers so that they are reciprocated by a drive from the manual lever between locked and unlocked conditions. A superlocking motor is operable to rotate the transmission connector angularly about a longitudinal axis and disengage the connector from at least one of the levers to disable the manual lever and effect superlocking for maximum security.

6 Claims, 2 Drawing Sheets

VEHICLE DOOR LOCK ACTUATOR

Figure 1:
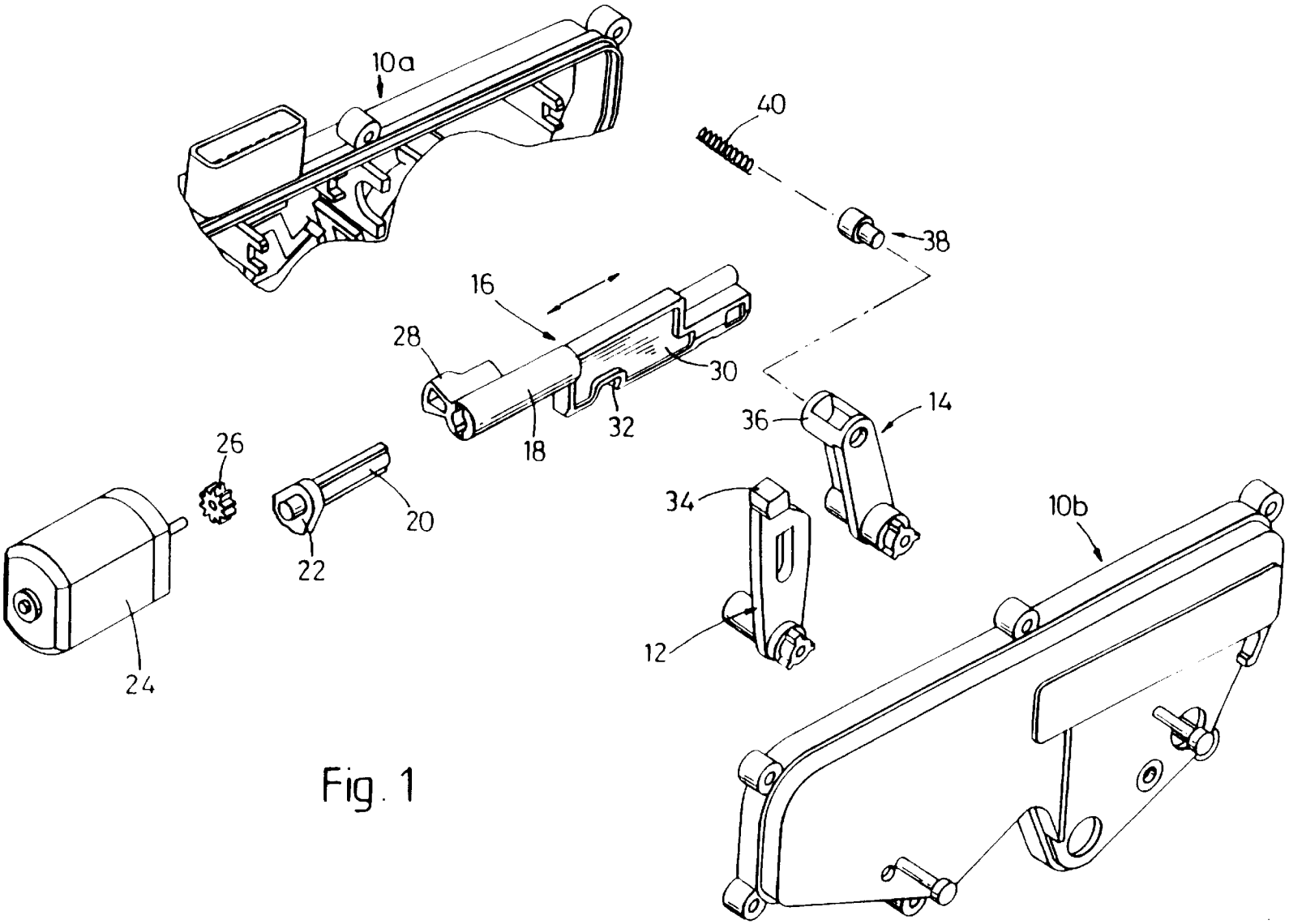

This invention relates to locking systems for vehicle doors and other closures of the kind in which the individual locks are interconnected through a central control unit for electrical actuation whereby locking or unlocking of all doors can be effected from a single control station actuated from within or outside the vehicle, herein referred to as "Central locking systems". More specifically the invention relates to the provision in said system of a power operated lock actuator incorporating a superlocking facility whereby the associated door latch cannot be freed from a locked condition even if access is gained to latch actuating elements within the vehicle. e.g. the interior door handle or sill button as by breaking a window or probing into or through the door.

It is known from our granted patent published GB 2285476-A to provide a power operated lock actuator with superlocking facility, said actuator including an actuator lever powered by main drive means for selectively setting lock mechanism in locked or unlocked conditions by movement between respective locked and unlocked positions; and linkage operable to drive connect a manual locking element to the actuator lever for manual shifting between said positions, the linkage including a longitudinally moveable sliding link coupled to the actuator lever and connected to the manual locking element through a floating connecting pin engaged in guide slots of said lever and element and shaped to provide a lost motion portion; superlocking being effected by selective powered shifting of an element also engaged with the pin to carry the latter into the lost motion portion whereby motion of the manual element is not transmitted to the sliding link.

The object of the invention is to provide an actuator having a remotely controllable powered superlocking facility which is convenient and reliable in operation, economical to produce, assemble and install, and which provides a high standard of security against tampering and attempted unauthorised entry to the vehicle.

According to the invention there is provided a power actuator as describe in appended claim 1.

Conveniently both the actuator element and the manual locking element are levers fulcrumed for angular movement in a plane or planes including or parallel to the connector axis, said first and second drive formations co-acting with arms of said levers.

Conveniently the actuator lever or other actuator element remains connected with the transmission connector throughout the angular movement of the latter and only the manual locking lever or equivalent element is disengaged therefrom at the disengaged position.

With the latter arrangement the assembly preferably further includes restoring means comprising a fixed camming abutment co-acting with a portion of the transmission connector remote from its axis at or near the end of its reciprocating travel towards the unlocking condition to return it automatically from the disengaged to the engaged angular position whereby connection with the manual locking element can be restored by operation of the actuator element.

To facilitate said reengagement the second drive formation and/or the coacting part of the manual locking element may include a resiliently loaded crank pin for self-engagement as restoring alignment of the components takes place.

The main drive means will conveniently include a main rotary electric drive motor with provision for alternative manual operation, for example from an external key operated lock cylinder of the respective vehicle door in use.

Said angular movement of the transmission connector is conveniently effected by a second or super locking rotary electric drive motor, for example having a pinion on its output shaft meshing with a toothed sector of the transmission connector.

Figure 2:
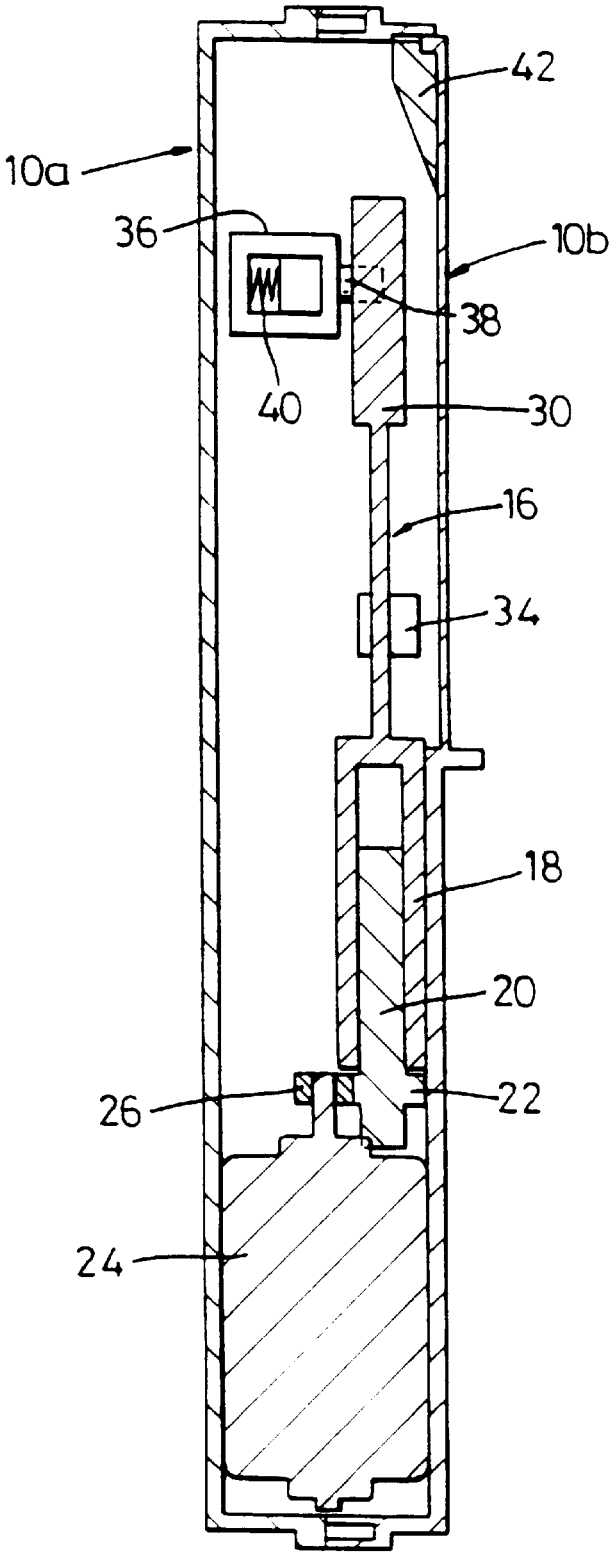

An example of the invention is now more particularly described with reference to the accompanying drawings wherein:

FIG. 1 is an exploded perspective view of parts of an actuator assembly, and FIG. 2 is a section in the plane of the longitudinal axis of a transmission connector of the assembly.

The assembly comprises a two-part actuator and locking mechanism housing formed of plastics mouldings, the main part 10*a* of said housing having a portion broken away in FIG. 1 and the cover part 10*b* being attached thereto by screws to form a unitary assembly for ease of installation and to give maximum protection to the lock and actuator components against ingress of dirt and moisture, and against unauthorised interference or tampering.

Contained within the housing will be a main rotary electric drive motor (not shown) selectively operable to shift an actuator element in the form of a locking lever 12 between locked and unlocked positions; and conventional locking mechanism (not shown) operating to secure the respective door latch (not shown) also of conventional construction, from being released when locking has taken place.

Lever 12 can also be operated manually, for example from a key actuated cylinder lock externally of the door in known manner and the actuator train acting on lever 12 may conveniently include the driver and indexing arrangement described and claimed in our said copending U.K. Patent Application dated Oct. 24, 1995 now examined Application G.B. 2,306,551, dated May 7, 1997 to which reference is made for further detail. It will be understood that the invention may also be combined with other forms of actuator drive and locking mechanism.

A manual locking element in the form of an inside lock lever 14 is fulcrumed on the housing on an axis parallel to the fulcrum axis of lever 12 and will be operatively connected to an interior sill button or interior door handle of the relevant door.

The near parallel upwardly extending arms of levers 12 and 14 are selectively coupled by a transmission connector 16 in the form of an elongate bar extending generally horizontally spaced above and across the lever axes.

Connector 16 is guided in housing main part 10*a* both for angular movement about its longitudinal axis between engaged and disengaged positions and for reciprocating movement along said axis between locking and unlocking conditions.

Connector 16 includes a tubular coaxial stem 18 at its left hand end as viewed in FIG. 1 having a splined interior for sliding engagement with a keyed driving shaft 20 of a toothed sector 22. An electric rotary superlocking motor 24 drives sector 22 by way of pinion 26. A limit stop 28 projecting radially from stem 18 coacts with abutments in housing part 10*a* to limit the angular travel.

Connector 16 can also slide longitudinally in the housing for reciprocating movement along its axis. Its right hand part is flattened and extends downwardly from its axis to form an engagement portion 30. A first drive formation in the form of a notch 32 in the lower edge of this portion mates with a crosshead 34 at the upper end of locking lever 12. Cross head 34 is shaped so that it remains in constant engagement with notch 32 regardless of the angular position of connector 16 about its axis and/or the angular position of lever 12, thus motion of said lever is transmitted to connector 16 to cause the reciprocating motion of the latter between locking and unlocking conditions.

The upper end of lever 14 will lie behind engagement portion 30 as viewed in FIG. 1 remote from notch 32 towards the right hand end of connector 16.

Said upper end includes a cage 36 integral with the lever end which locates a sliding crank pin 38 resiliently urged outwardly of cage 36 by a spring 40. The free end of pin 38 engages a socket (not shown) constituting a second drive formation in the back of engagement portion 30 when connector 16 is angled to the engaged position, it being shown in this position in the drawings i.e. with the engagement portion 30 depending vertically of the connector axis.

In this position levers 12 and 14 are linked together by connector 16. Operation of the sill button or the like will move lever 14 and so cause lever 12 to be shifted and cause manual locking and unlocking of the locking mechanism.

If the door is locked using the external key or by actuation of the central locking system to cause powered locking, lever 12 and transmission connector 16 will be shifted into locking condition moving to the left as viewed in FIG. 1 and lock lever 14 will also be moved depressing the sill button.

If left in this condition the door could be unlocked by unauthorised access to the interior for operating the sill button or the like, e.g. by breaking a window or possibly by "fishing" with an implement to engage the sill button or to engage its linkage with the actuator in the door interior.

For added security against this kind of activity the actuator can be set in superlocking condition in which operation of the sill button or equivalent is disabled.

This is effected by an operation of motor 24 to turn connector 16 angularly anticlockwise as viewed from the stem end. This moves the lower part of engagement portion 30 away from crank pin 38 of lever 14 so that the second drive formation is uncoupled. Movement of lever 14 will not displace lever 12 and unlocking cannot be effected by use of the sill button or its external linkage.

Superlocking can be cancelled by the reverse operation of motor 24 restoring connector 16 from the disengaged to the engaged position and reseating crank pin 38 in the socket. If the sill button has been moved while the mechanism was in the superlocked condition crank pin 38 may not be aligned with its socket, its resilient loading allows it to spring into place as soon as there is appropriate relative movement between connector 16 and lever 14.

Provision is also made for automatic reconnection i.e. cancellation of superlocking, by providing restoring means which turns connector 16 back to the engaged position automatically on longitudinal travel to the unlocked condition whether manually e.g. by the external key, or on powered actuation from the main drive motor, either of which moves lever 12 to carry connector 16 with it.

A fixed camming abutment in the form of a wedge 42 is provided in the corner of housing cover part 10*b* as seen in FIG. 2. This coacts with the lower leading corner of engagement portion 30 as it reaches the extremity of its travel to the unlocked condition, deflecting portion 30 back to its vertical alignment so that crank pin 38 will spring back into driving engagement therewith as referred to above. This provision means that an operation of a superlocking motor 24 is not required to reset the mechanism for subsequent locking and superlocking after unlocking has taken place.

The arrangement described provides an effective and reliable superlocking facility using simple and compact mechanism with a minimum of components and with ease of both powered and manual operation and control. It also provides for a choice of operating sequences and manners of use including in particular the convenience of a central locking system and provision of conventional manual operation.

It will be appreciated that the powered actuation could take various forms, for example a push-pull type electromagnetic or other power actuator motor could be coupled directly to the reciprocating transmission connector by a link or other form of actuator element rather than the rotary drive and lever arrangement described. The powered superlocking motor and drive could also take other forms, for example d push-pull motor linked to a crank pin on the transmission connector.

What is claimed is:

1. A power actuator for use in combination with a door latch and lock mechanism of a vehicle having a central locking system, said actuator comprising:

(a) an actuator element (12) operatively drivingly connected with the lock mechanism in use;

(b) a main drive for selective powered movement of said actuator element between locked and unlocked positions;

(c) a manual locking element (14) for operative connection to a manual drive;

(d) linkage serving to interconnect said manual locking element to the actuator element for manual locking and unlocking independently of said main drive, said linkage comprising a transmission connector (16) guided for reciprocating movement along a longitudinal axis of the transmission connector between locking and unlocking conditions, the transmission connector including first and second drive formations (32, not shown) coacting respectively with the actuator element and the manual locking element; and (e) a superlocking drive (20–26) acting on said linkage for selectively disconnecting the manual locking element from driving engagement with the actuator element, wherein the transmission connector is also guided for angular movement about said longitudinal axis between engaged and disengaged positions, said drive formations drivingly linking the actuator and manual locking elements in the engaged position to transmit movement therebetween by longitudinal reciprocation of the connector, and said superlocking drive having connection to the transmission connector to selectively effect said angular movement of the connector, said angular movement about the longitudinal axis of the transmission connector causing at least one said drive formations to be carried out of coacting relationship with the respective said element whereby the drive connection between the actuator and manual locking elements is disabled.

2. An actuator as in claim 1 wherein both the actuator element (12) and the manual locking element (14) are levers fulcrumed for angular movement in a plane or planes including or parallel to the axis of the connector (16), said first and second drive formations (20, not shown) coacting with arms (34,36) of said levers.

3. A actuator as in claim 1 wherein the actuator element (12) remains connected with the transmission connector (16) throughout the angular movement of the latter and only the manual locking element (14) is disengaged therefrom at the disengaged position.

4. An actuator as in claim 3 further including a fixed camming abutment (42) coacting with a portion of the transmission connector (16) remote from the connector axis at or near the end of the connector reciprocating travel towards the unlocking condition to return the connector automatically from the disengaged to the engaged angular position whereby connection with the manual locking element (14) is restored by operation of the actuator element.

5. A actuator as in claim 4 wherein the second drive formation and/or the coacting part (36) of the manual locking element (14) includes a resiliently loaded crank pin (38) for self-engagement as restoring alignment of the connector (16) takes place.

6. An actuator as in claim 1 characterised in that the angular movement of the transmission connector is effected by a rotary electric drive motor.

* * * * *